United States Patent [19]

Knüppel

[11] 3,955,876

[45] May 11, 1976

[54] ELECTRIC LAMP SOCKET

[75] Inventor: Fritz Knüppel, Ludenscheid, Germany

[73] Assignee: Vossloh-Werke GmbH, Werdohl, Germany

[22] Filed: Feb. 3, 1975

[21] Appl. No.: 546,749

[52] U.S. Cl. ..... 339/176 L
[51] Int. Cl.[2] ..... H01R 17/20
[58] Field of Search ..... 339/51 L, 61 L, 93 L, 339/176 L, 177–180, 182 L, 184 L

[56] References Cited

UNITED STATES PATENTS

| | | | |
|---|---|---|---|
| 955,438 | 4/1910 | Russell | 339/180 |
| 1,679,338 | 7/1928 | Rothenberg et al. | 339/180 |
| 1,727,148 | 9/1929 | White | 339/180 |
| 3,084,304 | 4/1963 | Sloan | 339/180 |

FOREIGN PATENTS OR APPLICATIONS

| | | | |
|---|---|---|---|
| 30,225 | 8/1959 | Finland | 339/180 |

*Primary Examiner*—Roy Lake
*Assistant Examiner*—Neil Abrams
*Attorney, Agent, or Firm*—Fitzpatrick, Cella, Harper & Scinto

[57] ABSTRACT

Electric lamp socket has a housing with a support block carrying a middle contact resilient in the direction of the central longitudinal axis of the socket, at least one side contact in the form of a blade, the support block being equipped with upstanding projections distributed over its periphery and being of such height that the base of a lamp inserted into the socket rests on the projections to an extent to depress the middle contact over at least part of its travel and that the side contacts or contact bear against an inwardly facing surface of a respective projection.

8 Claims, 2 Drawing Figures

ELECTRIC LAMP SOCKET

Figure 1:
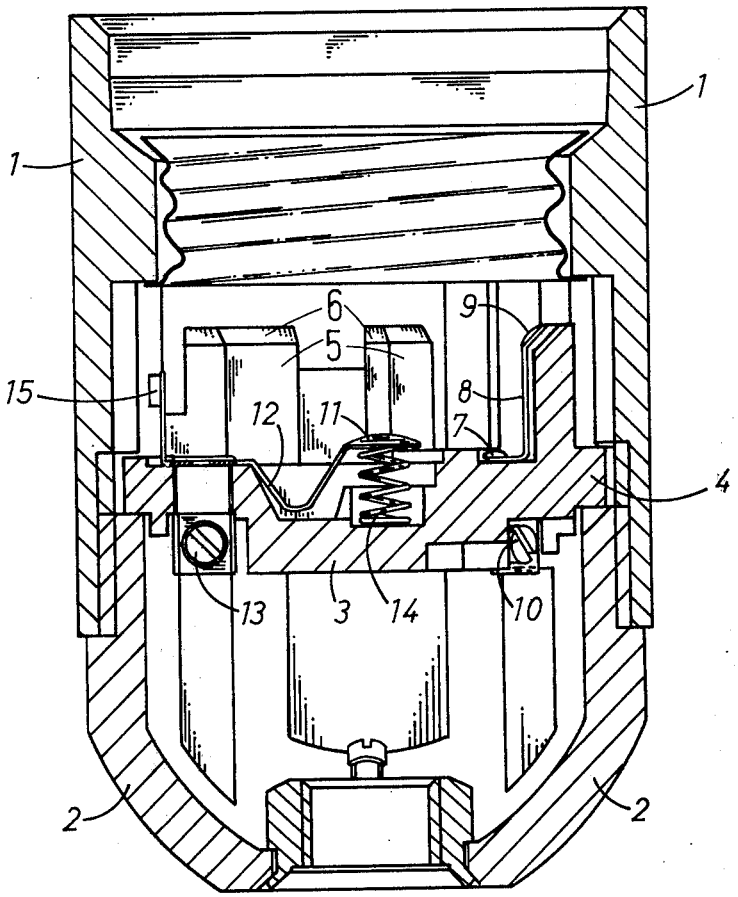

This invention relates to sockets, and more particularly, to electric lamp sockets or holders of the type comprising a cylindrical housing having a base, a support block inserted between the housing and the base, which support block carries a middle contact and at least one side contact.

In order to ensure good contact, the more recently adopted national and international standards relating to electrical equipment permit only a very small voltage-drop between the contacts of the lamp base and the contacts provided in the socket.

In order to compensate for dimensional variations which are unavoidable in the manufacture of the lamp, in the distance prescribed in the Standards between the contact ring and the center contact of the lamp base, at least one of the two socket contacts has to be resilient.

Sockets of the class described are known in which either the side contact or the middle contact is resilient, or in which both of them are resilient. Where both contacts are resilient, the use of socket contacts made of a copper alloy may result in the required small voltage-drop not being obtained. Because of the heavy thermal loading of the socket that occurs when a lamp burns out, there arises the danger of the contacts remaining in the position into which they were pressed when fitting the lamp, and of their not springing back to normal position because of their having lost their resilience. This is particularly so when screwing a lamp into a socket where only the minimum distance exists between the contact ring and the center contact of the lamp, so that the side contact of the socket has to deflect over a considerable distance. On the other hand, if a lamp whose base exhibits the maximum dimension between the contact ring and the center contact is screwed in, there arises the possibility that no contact at all is established. If the dimension is intermediate the minimum and maximum, it becomes impossible to achieve intimate contact between the contact ring and the side contact and this causes the contact resistance between the lamp base and the socket contacts to be very high and this can lead to destruction of both the lamp and the socket.

In one type of socket, the side contact takes the form of an annulus, on the inside diameter of which the base of the lamp can be firmly supported, so that the voltage-drop at the point of contact is small. An annular side contact however is expensive to produce and its use is disproportionately complicated.

Accordingly, I contribute by the present invention, a socket of the class described by which only a low voltage-drop occurs across the contacts. I am able to achieve this result by means of a side contact in the form of a single blade as permitted by the Standards.

In accordance with the invention, I provide an electric lamp socket comprising a cylindrical housing having a support block inserted between the housing and the base, which support block carries a middle contact, resilient in the direction of the central longitudinal axis of the socket, and at least one rigid side contact in the form of a blade, the support block being equipped with projections distributed over its periphery and extending parallel to the central longitudinal axis of the socket, the projections being of such height that the base of the lamp rests on the projections when it is screwed into the socket to such extent that the middle contact is depressed at least over part of its travel, and that the side contacts or contact bears against an inwardly facing surface of a respective one of the projections.

Preferably, the free end of each of the projections has an inwardly inclined surface, the free end of the side contacts or contact being angled to follow the contour of the corresponding inclined surface.

I also prefer that the middle contact be resiliently biassed by a spring made of a material which retains its spring force under high thermal load. In this manner, the middle contact is pressed reliably and firmly against the base contact of the lamp even when the spring force or resilience of the blade that carries the middle contact has become reduced somewhat by the effect of heat.

Because the side contact bears against one of the projections on the support block, the form of electric lamp socket in accordance with the invention enables complete rigidity and resistance displacement of the side contact to be maintained, so that movement thereof by pressure of the base sleeve on the side contact is precluded when the lamp is being screwed into the socket. The projections on the support block of the holder offer the further advantage that, when the lamp is being screwed into the socket, these projections provide a backing for the base sleeve, comprising the customary rounded portion, when the lamp is being inserted, and that the dimensional difference due to the screw-thread are reduced, and this, when the lamp is axially aligned, contributes to ensuring that the base sleeve is in full contact with the side contact of the socket.

There has thus been outlined rather broadly, the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

Figure 2:
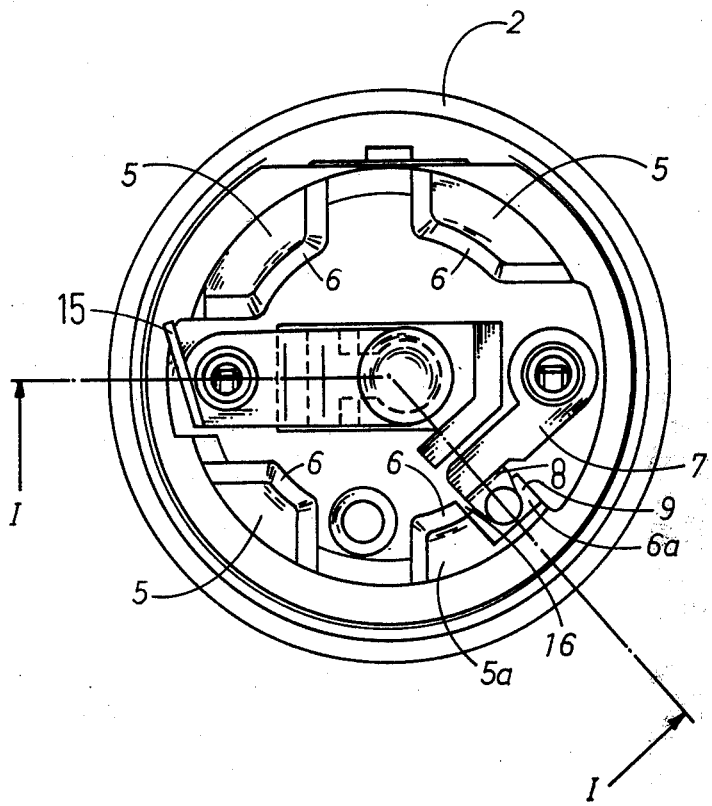

Specific embodiments of the invention have been chosen for purposes of illustration and description, and are shown in the accompanying drawings forming a part of the specification wherein:

FIG. 1 is an axial section through a lamp socket constructed in accordance with the invention taken along the line I—I of FIG. 2; and FIG. 2 is a plan view of the lamp socket of FIG. 1 with the cylindrical wall part unscrewed.

Referring now to the drawings, it will be seen that the lamp socket according to my invention consists of a cylindrical wall part 1 and a base 2. The edge of the base 2 has an external screw-thread whereby it is screwed into an internal screw-thread provided at the end of the cylindrical wall part 1. Between the cylindrical wall part 1 and the base 2 of the lamp socket is inserted a support block 3 which is clamped by an annular flange 4 between the cylindrical wall part 1 and the base 2 of the socket which may be made of plastic or ceramic material or may have a metallic casing.

The support block 3 has a number of upstanding projections 5 distributed equidistantly over its periphery, which projections extend parallel to the central longitudinal axis of the socket. The ends of the projections each have an inwardly inclined surface 6.

The lamp socket has a side contact comprising a plate 7 which merges into a blade 8 bent upwardly at right-angles. The blade 8 bears tightly against the inner face of one of the projections 5, namely the projections 5*a* (FIG. 2) which has an opening or recess 16 for receiving blade 8. This arrangement offers the advantage that the side flank of the projecting part of the projection 5*a* prevents the blade 8 from being moved in the clockwise direction as the lamp is screwed into the socket. The upper end 9 of the blade is angled to follow the inclined surface 6*a* of the projection 5*a*, and is provided with a stud for ensuring contact. Thus, the side contact is supported by virtue of its complementary angled end 9 bearing against the inclined surface 6. The plate 7 is also connected to a terminal bush 10 (FIG. 1) for connection to the external wiring. If desired, more than one side contact may be provided.

The side contact constructed as described above, is of simple shape and can therefore be produced at low cost.

The lamp socket further has a domed middle contact 11 which lies at the end of a resilient blade 12. Fitted below the middle contact 11 and bearing against the support block 3, is a spring 14 which is made of steel or of some other material which retains its spring force under heavy thermal loading. This spring may be a helical spring, as shown, or it may be a leaf spring. A plate 15, bent away from the middle contact, is provided to prevent the cylindrical wall part 1 from becoming unscrewed as the lamp is inserted. The blade 12 is connected to a terminal bush 13 (FIG. 1) which provides the other connection for external wiring.

From the foregoing description, it will be seen that I contribute, by the present invention, an electric lamp socket which assures reliable contact with the lamp base, a small voltage-drop across the lamp and socket contacts and which compensates for manufacturing dimensional variations in electric lamps. It will also be seen that the contacts of my novel socket retain their resilience under thermal loading and that such sockets can be mass produced at relatively low cost.

I believe that the construction and operation of my novel socket will now be understood and that the advantages thereof will be fully appreciated by those persons skilled in the art.

I claim:

1. An electric lamp socket comprising a housing, a support block in said housing and having spaced apart rigid projections distributed over its periphery and extending parallel to the central longitudinal axis of the socket, a middle contact carried by said support block, said contact being resilient in the direction of the central longitudinal axis of the socket, and at least one rigid side contact in the form of a blade mounted in the socket, said projections being of such height that the base of a lamp rests on inwardly facing surfaces of the projections when it is inserted into the socket to such extent that said middle contact is depressed at least over part of its travel, and said side contact bears against an inwardly facing surface of a respective one of the projections.

2. A socket according to claim 1, wherein said projections against which bear a respective side contact have, on said inwardly facing surface, a shallow opening for receiving said respective side contact.

3. A socket according to claim 2, wherein the free end of each of the projections has an inwardly inclined surface, and wherein said side contact is angled to follow the corresponding inclined surface.

4. A socket according to claim 2, wherein the middle contact is resiliently biassed by a spring made of a material which retains its spring force under high thermal load.

5. A socket according to claim 1, wherein the middle contact is resiliently biassed by a spring made of a material which retains its spring force under high thermal load.

6. A socket according to claim 5, wherein the spring is a helical spring.

7. A socket according to claim 6, wherein the spring is made of steel.

8. A socket according to claim 1, wherein said housing is formed of a wall and a base and said support block is formed with a flange clamped between opposed surfaces of said wall and said base.

* * * * *